United States Patent [19]

Chamberlain

[11] 4,270,320

[45] Jun. 2, 1981

[54] FRAMELESS SUBSTANTIALLY SPHERICAL BUILDING STRUCTURE

[76] Inventor: Craig Chamberlain, P.O. Box 5854, Huntington Beach, Calif. 92646

[21] Appl. No.: 60,604

[22] Filed: Jul. 25, 1979

[51] Int. Cl.[3] ..... E04B 1/32

[52] U.S. Cl. ..... 52/81; 52/748

[58] Field of Search ..... 52/80, 81, 82, 83, DIG. 10, 52/748; 135/1 R

[56] References Cited

U.S. PATENT DOCUMENTS

| | | | |
|---|---|---|---|
| 2,881,717 | 4/1959 | Fuller . | |
| 2,905,113 | 9/1959 | Fuller | 52/80 |
| 2,914,074 | 11/1959 | Fuller | 135/1 R |
| 3,063,521 | 11/1962 | Fuller . | |
| 3,197,927 | 8/1965 | Fuller | 52/81 |
| 3,203,144 | 8/1965 | Fuller | 52/81 |
| 3,354,591 | 11/1967 | Fuller | 52/81 |
| 4,092,810 | 6/1978 | Sumner | 52/81 |

OTHER PUBLICATIONS

"The Dome Builder's Handbook", John Prenis Editor, Running Press, Phil. Pa. Library of Congress Catalog No. 7419509, pp. 85–88.

*Primary Examiner*—J. Karl Bell

*Attorney, Agent, or Firm*—Jackson, Jones & Price

[57] ABSTRACT

A building or structure having a substantially hemispherical form is disclosed. The building is assembled from a plurality of prefabricated structural elements or panel members and is well suited for providing living and storage space and the like. Each of the panel members has a substantially spherical exterior surface, a curvature of which is determined solely by the desired radius of the hemi-spherical building. The panel members are attached to one another in a partially overlapping configuration. Points of attachment of the panel members are arranged according to a predetermined geometrical pattern or configuration. The buildings or structures of the invention show surprisingly large structural integrity even though panel members of relatively small wall thickness are used.

22 Claims, 7 Drawing Figures

FRAMELESS SUBSTANTIALLY SPHERICAL BUILDING STRUCTURE

BACKGROUND OF THE INVENTION

1. Field of the Invention

The present invention relates to a frameless substantially spherical building structure, and more particularly to a frameless substantially spherical building structure which is assembled from a plurality of panel members having spherical outer surfaces.

2. Brief Description of the Prior Art

The prior art is well aware of building structures having a dome shaped or substantially hemispherical overall appearance. Dome or substantially hemispherically shaped buildings of the prior art usually include a plurality of framing members which support a plurality of substantially flat outer members in such a manner that the dome or hemispherical structure in reality is a multifaceted polyhedron. Such building structures are usually referred to as geodesic structures or geodesic domes.

For detailed description of geodesic structures or domes, reference is made to U.S. Pat. Nos. 3,197,927; 3,354,591; 3,203,144; 3,063,521; 2,914,074; 2,905,113; 2,881,717; 2,682,235 and to the publication "The Dome Builder's Handbook", John Prenis Editor, Running Press Philadelphia, Penna., Library of Congress Catalog Card No. 7419509.

Although geodesic structures have increased somewhat in popularity during the recent years, their application for construction of homes, small workshops, office spaces, storage buildings and the like is still far from being widespread. This is probably due to the fact that geodesic structures of the prior art still generally require support frames, struts and the like which are covered by substantially flat outside panels. In light of this, the overall cost of constructing these structures does not provide a very significant advantage over the cost of constructing conventional building structures.

In addition, it is noteworthy that prior art geodesic structures have not really broken with the old tradition of using component building blocks having straight lines or dimensions. This is generally true even though U.S. Pat. No. 3,197,927 describes a geodesic structure wherein individual structural components have spherical outside surfaces. These components include upwardly extending arcuate side flanges located on their peripheries. The components are then joined together side-by-side by tension rings which engage the flanges. It is readily apparent, however, that construction of such components to provide a side-by-side interlocking geodesic pattern is rather expensive. Perhaps for this and other reasons this structure too has failed to gain widespread acceptance in the construction industry.

In light of the above, it is readily apparent that there is a real need in the building arts and particularly in the geodesic or dome building arts for a revolutionary new design for a substantially spherical structure which is simple to construct from a few prefabricated elements at a fraction of the cost of prior art geodesic or conventional structures.

SUMMARY OF THE INVENTION

It is an object of the present invention to provide a substantially dome shaped frameless building structure which is constructed from a plurality of simple, relatively inexpensive, prefabricated components.

It is another object of the present invention to provide a substantially dome shaped frameless building structure which is assembled from component parts in a relatively short period of time.

It is still another object of the present invention to provide a frameless building structure, which is substantially spherical in appearance, and save for doors, windows and the like, contains no components having straight lines or flat surfaces.

These and other objects and advantages are attained by a building which substantially has the shape of a sphere of a predetermined radius cut off along a truncation plane comprising a support surface upon which the building rests. The building or structure is constructed from a plurality of prefabricated panel members which are joined together in a partially overlapping configuration. Each panel member has a substantially spherical exterior surface, and preferably also a spherical interior surface, with the spherical exterior surface having a curvature defined by the radius of the building or structure.

The individual panel members are joined to one another in the overlapping configuration by fasteners which are incorporated into the panel members according to a predetermined geometrical configuration so that assembly of the panel members to one another is simple and requires relatively little time or skill. The building or structure, although frameless, is remarkebly strong and is well suited for providing living or storage space and the like.

The objects and features of the present invention are set forth in the appended claims. The present invention may be best understood by reference to the following description, taken in connection with the accompanying drawings in which like numerals indicate like parts.

DESCRIPTION OF THE PREFERRED EMBODIMENTS

The following specification taken in conjunction with the drawings sets forth the preferred embodiment of the present invention in such a manner that any person skilled in the geodesic building arts can use the invention. The embodiments of the invention disclosed herein are the best modes contemplated by the inventor for carrying out his invention in a commercial environment, although it should be understood that various modifications can be accomplished within the parameters of the present invention.

Figure 1:
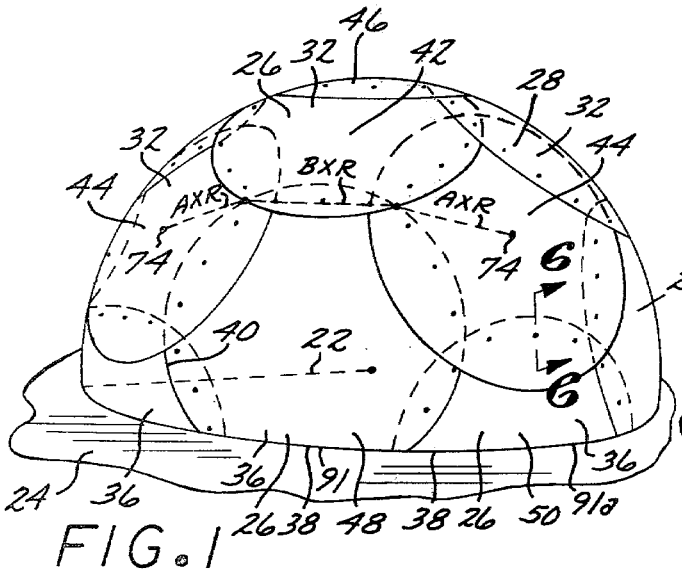
FIG. 1 is a schematic perspective view of a first specific embodiment of a frameless building structure of the present invention.

Referring now to FIGS. 1, 3, 4 and 5 and particularly to the perspective view of FIG. 1, a first specific embodiment of the present invention comprising a frameless spherical building structure 20, is disclosed. The building structure or building 20 is a geometrically perfect sphere which is cut off along a truncation plane. Stated more accurately, the building 20 of the first specific embodiment approximates a sphere as closely as rendered possible by minor deviations from a desired predetermined geometrical form of the several structural elements or panels which form the building 20. The first specific embodiment of the building 20 encloses space which corresponds to $\frac{5}{8}$ of the volume of a sphere having the same radius as the radius of the building 20. The radius of the building 20 bears the reference numeral 22 on FIG. 1. The building or structure 20 is placed on a support surface 24 which may comprise a level concrete foundation customarily used in the construction industry.

It is an important feature of the present invention that the building or structure 20 is assembled from a plurality of prefabricated structural elements. As is shown on the perspective view of FIG. 1, the structural elements comprise members which have a curvature determined by the radius 22 of the building or structure 20. These structural elements or members hereinafter are referred to as panel members or panels 26. As is stated above, each panel member 26 has a spherical exterior surface 28, and preferably also a spherical interior surface 30. The spherical interior surface 30 is shown in the cross sectional view of FIG. 7 with reference to a third specific embodiment of the frameless building or structure of the present invention.

The panel members 26 utilized for the construction of the frameless building or structure 20 may be made from several structural materials, such as polymethyl methacrylate (plexyglass), polypropylene, various metal, and fiberglass reinforced polyester resin. The most preferred material for the construction of the frameless building structure 20 of the first specific embodiment of the present invention, which has a 10 foot radius, is fiberglass reinforced polyester resin of $\frac{1}{8}''$ thickness.

It is to be emphasized that an important discovery of the present invention lies in the fact that buildings of very high structural integrity may be constructed in accordance with the present invention from relatively thin panel members 26, such as the above described fiberglass reinforced polyester panels of $\frac{1}{8}''$ thickness. For the construction of the building 20 of the first specific embodiment having a 10 foot radius panel 26, custom manufactured by Molded Fiberglass Co. of Costa Mesa, Calif., were utilized.

It is to be understood that the selection of the material of the panel members 26 and their thickness should be made according to the size of the building or structure which is to be constructed in accordance with the present invention, although the above described $\frac{1}{8}''$ thick fiberglass reinforced polyester panel members 26 are suitable for construction of buildings or structures accommodating small and medium sized dwellings, shops, storage spaces, and the like.

The number of the panels 26 which are required for the construction of the frameless building or structure 20 is determined by the requirement that the individual panels 26 must partially overlap to provide a structure which save for doors, windows and the like, completely encloses the space beneath the structure 20. In this regard, a designer of the frameless building or structure 20 must be familiar with certain basic concepts of spherical geometry which will be reitterated here only to the extent necessary for a complete understanding of the present invention. Detailed teachings of spherical geometry may be found in standard text books of geometry, and to a limited extent in the above referenced United States Patent documents and in the above referenced publication "The Dome Builder's Handbook". The specifications of U.S. Pat. Nos. 3,197,927; 3,354,591; 3,203,144; 3,063,521; 2,914,074; 2,905,113; 2,881,717, and 2,682,235 are hereby expressly incorporated by reference.

Still referring to FIG. 1, it is shown that the panel members 26 from which the building or structure 20 is assembled, may be classified in the following manner. Nonoverlapping portions of the panel members 26 in the assembled structure 20 form certain geometrical configurations, and each class of the panel members 26 is hereinafter referred to according to the geometrical configuration or pattern formed on that panel member 26.

For the construction of the building or structure 20 basically two types of panel members 26 are utilized. A first type of panel member 32 has a circumferential edge 34 which comprises a substantially perfect circle. Panel members of the first type 32 are best shown on FIGS. 1, 3 and 4. These panel members of the first type 32 may also be characterized as circular segments of a sphere having the same radius of curvature as the radius 22 of the building 20.

A second type of panel member 36 has a configuration similar to the configuration of the first type of panel members except that each of the panel members of the second type 36 are cut off by a truncation plane. Thus, the panel members of the second type 36 have a circumferential edge which consists of two portions, a first portion 38 which is in contact with the support surface 24, and a second portion 40 which comprises an arc of a circle. For the construction of the frameless building or structure 20 of the present invention, it is preferred that a radius of the aforementioned circles is the same for the panel members of the first type 32 as well as for the panel members of the second type 36. This feature greatly simplifies the design of the prefabricated panel members 26 which are easily assembled to provide the building or structure 20.

Panel members of the first type 32, although being of exactly the same size for the construction of the first specific embodiment of the present invention, are then further classified according to the shape of their nonoverlapping portions in the assembled structure 20.

FIG. 1 shows that panel members of the first type 32 include several panel members having spherical hexagonal nonoverlapping portions, spherical pentagonal nonoverlapping portions, and one additional panel member having a spherical pentagonal nonoverlapping portion. These three kinds of panel members respectively bear the reference numerals 42, 44 and 46. For the sake of the present description these panels are hereinafter respectively referred to as upper hexagonal panels 42, pentagonal panels 44, and top pentagonal panel 46. It is to be emphasized that the upper hexagonal panels 42, pentagonal panels 44 and the top pentagonal panel 46 in the first specific embodiment of the present invention all are of the same size. They differ from one another only in the specific, predetermined geometrical configuration in which a plurality of fastener members are attached to the respective panels.

The panel members of the second type 36 are further classified into two kinds as follows. FIG. 1 shows that panel members of the second type 36 include several panel members the nonoverlapping portion of which comprise partial spherical hexagons, with a first kind of the panel members of the second type 36 being substantially larger than a second kind. Accordingly, the larger and smaller panel members of the second type respectively bear the reference numerals 48 and 50 and for the sake of brevity are hereinafter respectively referred to as bottom hexagonal panels 48 and half hexagonal panels 50.

The frameless building or structure 20 of the present invention includes exactly 5 upper hexagonal panels 42, 5 pentagonal panels 44, 1 top pentagonal panel 46, 5 bottom hexagonal panels 48, and 5 half hexagonal panels 50.

As it was briefly mentioned above, it is an important objective of the present invention that the panel members 26 are prefabricated and therefore lend themselves for easy assembly to provide a building or structure such as the frameless building 20 of the first specific embodiment. Experience has shown that this objective is readily accomplished when the above described panel members 42, 44, 46, 48 and 50 having the same radius on their respective circular circumferential edges 34 and 40, are utilized. Each of these panel members 42, 44, 46 and 48 has a curvature which corresponds to the radius 22 of the substantially spherical building or structure 20.

It will be readily appreciated by those skilled in the art that the exact number of the above described panel members 26 is determined by rules of spherical geometry. However, it will also be readily apparent to those skilled in the art, that a different number of panel members of a different shape than described above may be assembled to form a frameless spherical building structure in accordance with the present invention. In this regard the requirements are that each of the panel members must have a substantially spherical exterior surface. Furthermore the precise geometrical pattern according to which the panel members are to be assembled to one another, must be predetermined. Accordingly, the herein described first specific embodiment of the present invention and particularly the ensuing description of the specific geometrical pattern employed for incorporating fastening members or means for attaching the panels to one another is intended to be exemplary rather than limiting in nature.

Figure 6:
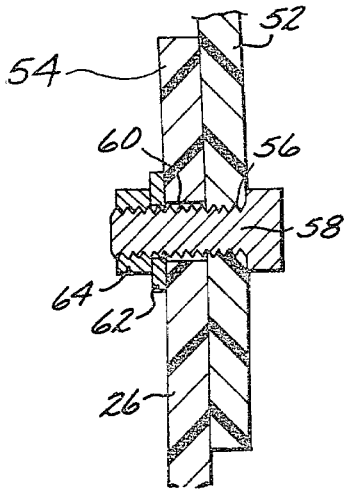
FIG. 6 is a partial cross sectional view of two adjoining panel members of the present invention, the view being taken at lines 6,6 of FIG. 1.

It has been found in accordance with the present invention that attachment of the panel members 26 to one another may be accomplished by using a plurality of bolts and nuts. Such an attachment is shown in detail on the cross sectional view of FIG. 6 wherein the reference numeral 52 indicates an overlaying portion of a panel member 26 and the reference numeral 54 indicates an underlying portion of a panel member 26. In other words, the portion 52, shown on FIG. 6, is located on the exterior of the building structure 20 while the portion 54 is located in the interior of the building structure 20. Experience has shown that attachment of the panel members 26 to one another by bolts and nuts in the herein described manner results in a building 20 which is water proof. In alternative embodiments, however, insulating gaskets at the points of attachment may be employed. In addition, those skilled in the art will readily recognize that alternative means for fastening the panel members 26 to one another may be employed without departing from the scope of the present invention.

In order to facilitate the assembly of the panel members 26 to one another, each overlaying portion 52 is provided by a plurality of threaded holes 56 which are located in the hereinafter described predetermined geometrical configuration. A bolt 58 is placed into each of the threaded holes 56 prior to the actual assembly of the panel members 26 to one another. Each underlying portion 54 of the panel members 26 is provided with a hole 60 which is slightly larger in diameter than the diameter of the bolt 58. The holes 60 are hereinafter referred to as the oversized holes and the threaded and oversized holes 58 and 60 are collectively referred to as apertures 61. The oversized holes 60 are also located in strict adherence to the predetermined geometrical configuration.

As the panel members 26 are assembled to one another, the threaded holes 56 bearing the bolts 58 and the oversized holes 60 are aligned with one another. The bolts 58 are then inserted into the respective oversized holes 60. A conventional washer 62 and a nut 64 is then placed from the interior of the frameless building 20 upon the bolts 58, and the nuts 64 are tightened. Experience has shown that the above described technique of attaching the panel members 26 to one another provides a very significant advantage in that the assembly of a structure having a 10 foot or even larger radius 22 may be accomplished entirely from the interior of the structure 20 and the erection of a scaffolding is not necessary. This, of course, greatly reduces the amount of labor required for erecting the structure 20 and hence reduces the attendant cost.

Figure 3:
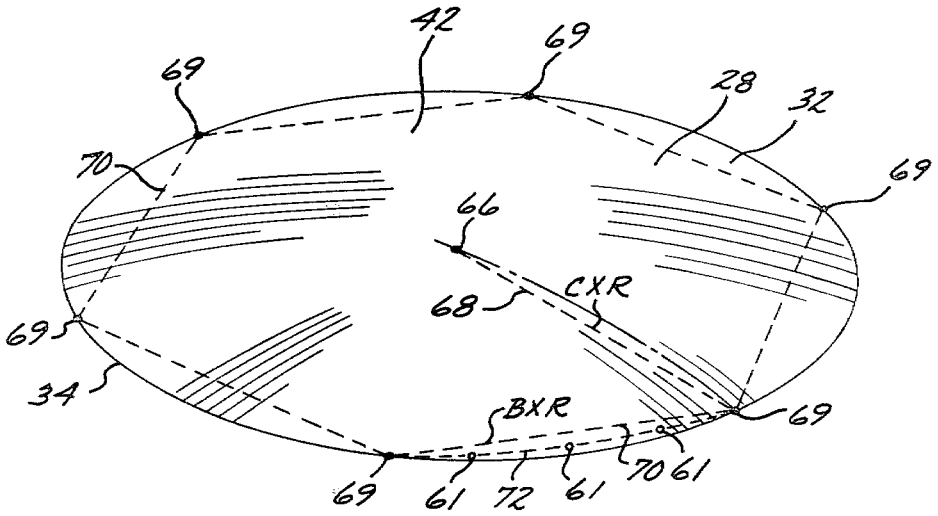
FIG. 3 is a schematic perspective view of a first panel member of the present invention, nonoverlapping portions of which comprise spherical hexagons, the view showing the location of a plurality of apertures on the first panel member.
Figure 4:
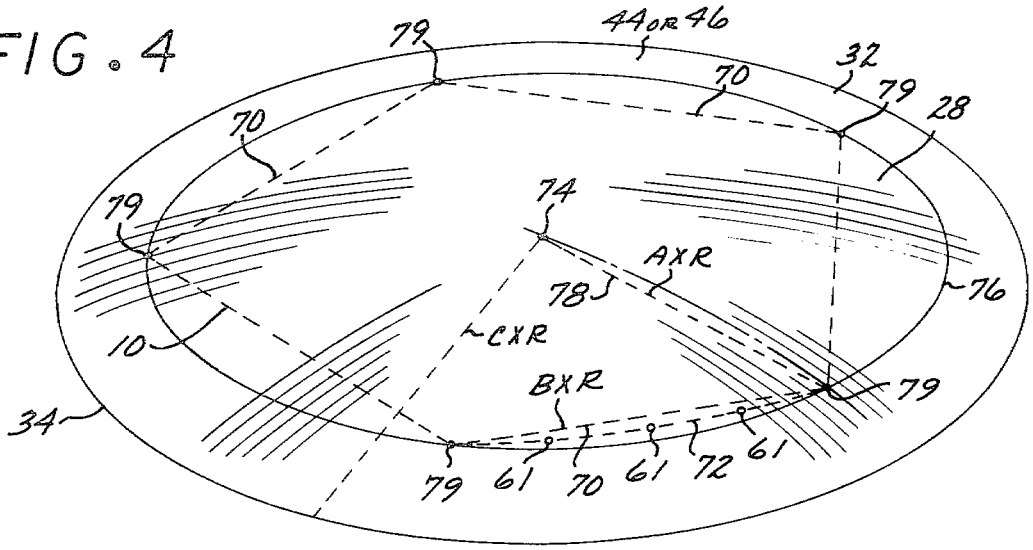
FIG. 4 is a schematic perspective view of a second panel member of the present invention nonoverlapping portions of which comprise spherical pentagons, the view showing the location of a plurality of apertures on the second panel member.

Referring now to FIGS. 3 and 4, a convenient method is shown for establishing a predetermined geometrical configuration or pattern according to which the apertures 61 may be located on the panel members 26.

In the frameless building or structure 20, shown on FIG. 1, each upper hexagonal panel 42 has the same radius as the radius of all the other panel members 44, 46, 48 and 50. In this regard, the term "radius" of the upper hexagonal panel 42 is used here to describe a distance between a center point 66 located on the exterior surface 28 of the hexagonal panel 42 and any point located on the circumferential edge 34 of the hexagonal panel 42. On FIG. 3 the distance between the center point 66 and any point on the circumferential edge 34 is indicated by dashed lines and bears the reference numeral 68. As is readily apparent to those skilled in spherical geometry and particularly in the geodesic construction arts, the distance 68 does not comprise a true geometrical radius of the circular circumferential edge 34. Instead, it is more accurately termed in accordance with standard nomenclature used in the geodesic construction arts, as a cord line. In the first specific embodiment described here the cord line 68 has an overall length of C×R wherein R represents the true radius 22 of the substantially spherically shaped frameless building 20 and C equals a constant, having the numerical value of 0.4124.

In conventional geodesic structures the term "cord line" is customarily used to describe the distance from the center of a flat polygonal panel member to the corner of the same polygonal panel member and also to describe a straight line distance between adjacent corners of the flat polygonal panel members. As it will be readily recognized from the ensuing description the cord line 68 actually corresponds to a straight line distance between the center 66 of the upper hexagonal panel 42 and the intersection point 69 of the same upper hexagonal panel 42 with one adjoining panel member 26. The numerical value of the constant C is inherent from the geometry of the herein described specific embodiment of the present invention. The numerical value of the constant C is readily available from standard texts describing geodesic constructions, such as the above cited publication "The Dome Builder's Handbook".

Having thus determined the size of the upper hexagonal panel member as a sole function of the radius (R) of the substantially frameless building structure, the location of the apertures 61 is further determined as follows. A second cord line distance which equals B×R, wherein B is a constant having the numerical value of 0.4035, is measured along the circumferential edge 34 of the upper hexagonal panel 42, as is shown on FIG. 3. The B×R distance bearing the reference numeral 70, can be measured exactly 6 times along the circumferential edge 34. Therefore the points obtained in this manner define an even sided hexagon which lies in a plane intersecting the spherical exterior surface 28 of the hexagonal panel 42. The corners of the even sided hexagon also define a spherical hexagon on the spherical exterior surface 28 of the hexagonal panel 42; the spherical hexagon being best shown on the perspective view of FIG. 1.

After the corners of the spherical hexagon have been determined in the above described manner on the exterior surface on the hexaganol panel 42, respective great circle distances 72 between adjacent corners of the spherical hexagon are determined.

As is well known to those skilled in spherical geometry, a great circle distance on the surface of a sphere or a globe is the shortest distance interconnecting any two points on the surface of the sphere or globe. Such a distance is referred to as a great circle distance because the shortest line interconnecting the two points on the surface of the sphere is by necessity an arc of a circle which has a center point identical with the center point of the sphere or globe.

The great circle distances 72 may be empirically measured and marked on the exterior surface 28, e.g. by stretching a tape measure between the respective two corner points 69 on the surface of the upper hexagonal panel 42. The apertures 61 are then placed on the great circle arcs 72 distributed evenly on the arcs. Thus, as is shown on FIG. 3, three apertures 61 are provided on each of the great circle arcs 72. Therefore a great circle distance between each of the apertures 61 corresponds to $\frac{1}{4}$ of the total great circle distance 72 between two adjacent corners 69 of the spherical hexagons. Although FIG. 3 shows the placement of three apertures 61 only on one of the great circle arcs 72, it is to be understood that the apertures 61 are placed in the same manner along each of the great circle arcs 72 which interconnect on the exterior surface 28 of the upper hexagonal panels 42 adjacent corners 69 of the spherical hexagons.

Referring now to the schematic view of FIG. 4, respective placement of the apertures 61 on the pentagonal panels 44 and the top pentagonal panel 46 is shown. For the building or structure 20, a straight line distance between a center point 74 located on the exterior surface 28 of the pentagonal 44 or top pentagonal 46 panel and any point on the circumferential edge 34 of the panel 44 or 46 equals C×R. Stated differently, the pentagonal panel 44 and top pentagonal panel 46 are of the same overall size as the upper hexagonal panel 42. A circle 76 is drawn upon the exterior surface 28 of the panel 44 or 46 with the center of the circle 76 being located below the center 74 of the panel 44 or 46. A straight line distance 78 between any point of the circle 76 and the center 74 of the panel 44 or 46 equals A×R wherein A is a constant having the numerical value of 0.3486. The linear distance B×R 70 is then measured along the circumference of the circle 76 as is shown on FIG. 4. The distance B×R 70 fits exactly 5 times into the circle 76. Therefore the points 79 obtained in this manner on the circle 76 define an even sided pentagon in a plane located below the surface of the pentagonal panel 44 or top pentagonal panel 46. The points 79 also define a spherical pentagon on the exterior surface 28 of the panel 44 or 46. The apertures 61 corresponding to the threaded 56 or oversized holes 60 are then placed upon the panel 44 or 46 in the same manner as described above for the upper hexagonal panel 42. Thus, respective great circle distances between adjacent corners 79 of the spherical pentagon are measured and marked on the surface 28 of the panel member 44 and 46 and the apertures are evenly distributed along the respective great circle distances.

It should be expressly understood that although FIGS. 3 and 4 show 3 apertures 61 on the great circle arc 72, a different number of apertures 61 may be provided. It should also be expressly understood that placement of the apertures 61 on the panel members 26 in the above described manner is, although convenient and very suitable for the purpose of practicing the present invention, is not critical. What is critical is to provide means for fastening the several panel members 26 to one another in a predetermined geometrical configuration or pattern so as to obtain an enclosed structure.

Figure 5:
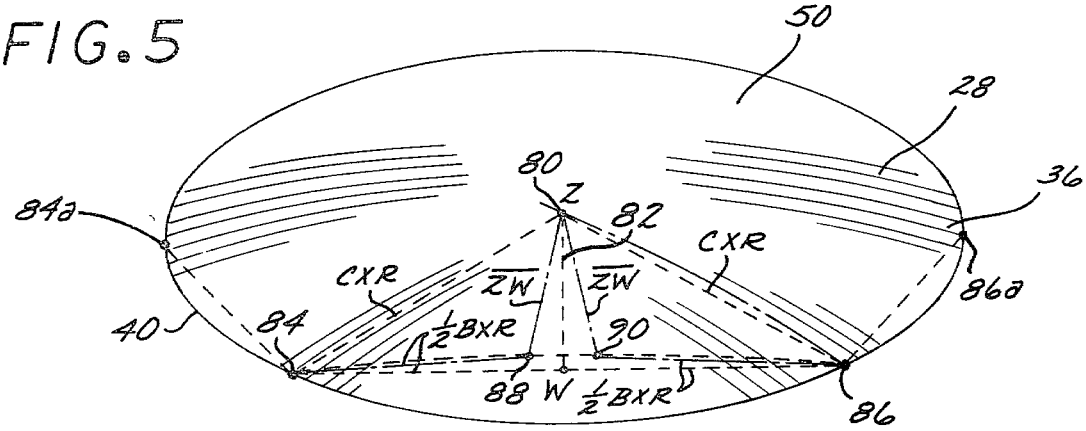
FIG. 5 is a schematic perspective view of a third panel member of the present invention nonoverlapping portions of which comprise partial spherical hexagons, the view showing the location of a truncation line on the third panel member, and a semi-empirical method for determining the same.

Referring now to the schematic view of FIG. 5, a semi-empirical method for determining a truncation plane for the bottom hexagonal panel 48 of the first specific embodiment of the present invention is disclosed as an example. The bottom hexagonal panel 48 save for a cut-away portion being of the same size as the upper hexagonal panels 42, has a distance between its center point 80 and any point on its circular periphery 40 which equals C×R. Again, save for the cut-away portion, the apertures 61 are placed on the bottom hexagonal panels 48 in the same manner as for the upper hexagonal panels 42. In order to approximate the truncation line the length of an unknown third side of a right triangle is calculated. The right triangle has two sides of known dimensions, respectively being C×R and $\frac{1}{2}$×B×R, as is indicated on FIG. 5. The unknown side of this right triangle is a straight line distance between points Z and W, bearing the reference numeral 82. In this regard it is noted that the point W lies below the exterior surface 28 of the bottom hexagonal panel 48. Once the distance $\overline{ZW}$ 82 has been calculated, an arc is drawn with the $\overline{ZW}$ distance 82 upon the surface 28 of the panel member 48 from the center 80 of the panel member 50. Additional arcs respectively drawn from the corners of the right triangles bearing the reference numerals 84 and 86 with a distance of $\frac{1}{2}\times B\times R$, are marked upon the exterior surface of the bottom hexagonal panel 48. Intersections of the arcs respectively provide points 88 and 90 on the exterior surface 28 of the bottom hexagonal panel 48. A line drawn on the surface 28 interconnecting points 84, 88, 90 and 86 in the above described sequence with reference to FIG. 5, provides a good approximation of the truncation line 91 (shown on FIG. 1) of the bottom hexagonal panel 48.

A truncation line for the half hexagonal panels 48 may be determined by an analogous emperical method of approximation. Briefly, a great circle line (not shown) is marked on the exterior surface 28 of the panel, shown on FIG. 5, between two corners of the spherical hexagon such as points 84 and 86. Another great circle line (not shown) is marked on the surface 28 between adjacent corners of the spherical hexagon. These corners respectively bear the reference numerals 84*a* and 86*a* on FIG. 5. From a midpoint of the great circle distance between points 84 and 86 an arc is drawn with the distance of $\overline{ZW}$ on the surface 28 to intersect with the great circle between points 84*a* and 86*a* to give an intersection point (not shown). A line drawn between point 84*a*, the intersection point (not shown) and point 86*a* provides a good approximation of a truncation line 91*a*, shown on FIG. 1, of the half hexagonal panel 50.

Other emperical and theoretical methods of determining the truncation planes of the herein described substantially spherical structures may be readily apparent to those skilled in the geodesic construction arts and in spherical geometry. Accordingly, the above described methods are intended to serve as examples rather than to limit the scope of the present invention. Location of the apertures 61 in the half hexagonal panels 50 may be determined in the same manner as for the upper hexagonal panels 42.

The frameless building or structure 20 described as the first specific embodiment of the present invention is termed, by analogy to the geodesic structures of the prior art, as a three frequency structure. This means that a distance between the center 74 of a pentagonal panel member 44 to the like center 74 of the most proximate pentagonal panel member 44 corresponds to three cord line distances. On FIG. 1 these three cord line distances are shown in dashed lines and their dimensions are respectively indicated as $A\times R$, $B\times R$, and $A\times R$. Substantially spherically spaced frameless building structures of a higher frequency may also be constructed in accordance with the present invention. Such structures of a higher frequency require a larger number of panel members than the three frequency structures described here, however the panel members are of a smaller size.

Figure 2:
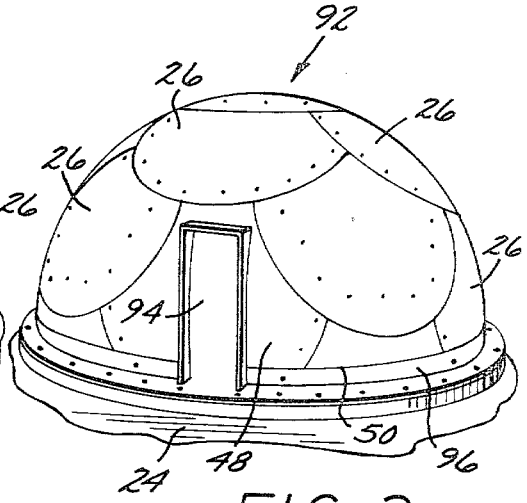
FIG. 2 is a schematic perspective view of a second specific embodiment of a frameless building structure of the present invention.

Referring now to FIG. 2, a substantially spherical building or structure 92 is disclosed which is constructed in a manner similar to the construction of the structure 20. The building 92 however, is provided with an entrance schematically shown as a doorway 94. In addition, the half and bottom hexagonal panels 48 and 50 of the building 92 are mounted to a flange 96 which is attached to the support surface 24. Additional doorways (not shown), windows (not shown) and the like may be provided on the building 92. Furthermore, in a construction designed in accordance with the present invention several buildings or structures such as 20 and 92 may be provided and may be interconnected by passage or hallways (not shown).

Figure 7:
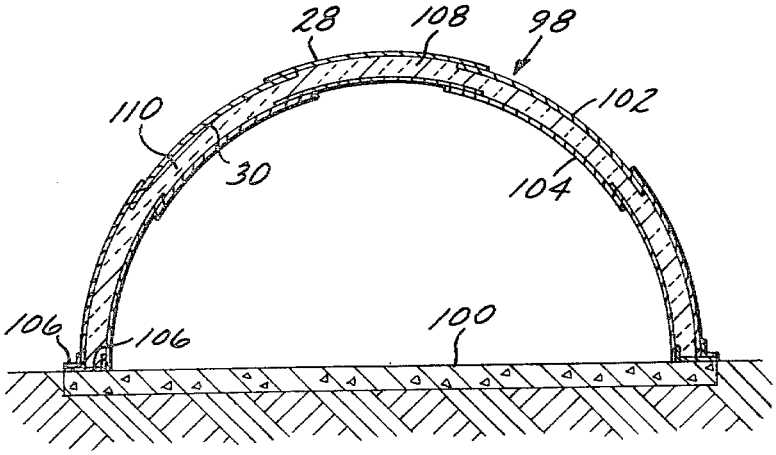
FIG. 7 is a cross sectional view of a third specific embodiment of a frameless building structure of the present invention.

FIG. 7 is a schematic cross sectional view of a building 98 which comprises a third specific embodiment of the present invention. The building 98 is supported by a concrete foundation 100 to which first and second spherical structures 102 and 104 are respectively attached through suitable flanges 106. The second spherical structure 104 is slightly smaller in diameter than the first spherical structure 102. A space 108 located between the two spherical structures 102 and 104 is filled with suitable insulating material 110. The building 98 is very well suited for human occupation even in cold or otherwise harsh climates.

What has been described above is a substantially spherical building or structure which is readily assembled from a plurality of prefabricated structural elements. The building or structure of the present invention provides several advantages over conventional construction and over prior art geodesic structures. These advantages include substantially lower costs in construction, an aesthetically pleasing spherical appearance, and surprisingly great structural integrity. Several modifications of the present invention may be made by those skilled in the art without departing from the scope and spirit thereof. Accordingly the scope of the present invention should be interpreted solely from the following claims.

What is claimed is:

1. A building having substantially the shape of a sphere cut-off by a truncation plane, the sphere having a geometrical radius defining a radius of the building, the building comprising:

a plurality of panel members attached to one another in partially overlapping configurations, each panel member having a substantially spherical exterior surface having a curvature defined by the radius of the building the panel members including panel members of a first kind which are substantially circular segments of a sphere and the panel members further including panel members of a second kind which are partial circular segments of the sphere, the partial circular segments having a circumferential first edge which comprises a truncation line of the domed shaped building, the first edge substantially in contact with a support surface upon which the building rests.

2. The invention of claim 1 wherein a circumferential edge of each of the panel members of the first kind defines a first circle, a radius of the circle being identical for each of the panel members of the first kind, and wherein each of the panel members of the second kind have a circumferential second edge defining an arc of a second circle.

3. The invention of claim 2 wherein the second circle has the same radius as the first circle.

4. The invention of claim 1 wherein the panel members of the first kind include exactly six panel members nonoverlapping portions of which respectively comprise spherical pentagons, and exactly five panel members nonoverlapping portions of which comprise spherical hexagons, and wherein the panel members of the second kind include exactly ten panel members nonoverlapping portions of which comprise partial spherical hexagons.

5. The invention of claim 4 wherein the panel members are attached to one another by fasteners inserted into apertures provided on the panel member.

6. The invention of claim 5 wherein the apertures provided in the panel members are provided on great circle lines respectively connecting adjacent corners of spherical hexagons and pentagons located respectively on the panel members.

7. A structure for providing living and storage space and the like, the structure having the shape of a sphere of a predetermined radius cut off along a truncation plane, the truncation plane being substantially defined by a support surface upon which the structure rests, the structure comprising:

a plurality of preformed panel members assembled to one another in a partially overlapping configuration, each panel member in its preformed state and in the structure having a spherical exterior surface of substantially the same radius as the spherical structure and a spherical interior surface of a radius slightly smaller than the radius of the spherical structure, means for attaching the panel members to one another being provided on each panel member in a predetermined geometrical configuration prior to the assembly of the panel members to form the structure, the means being aligned on each panel member relative to each adjacent panel member.

8. The invention of claim 7 wherein nonoverlapping portions of the panel members in the assembled structure are one of spherical pentagonal, spherical hexagonal and partial spherical hexagonal configuration.

9. The invention of claim 8 wherein the means for attaching the panel member relative to one another are located on several great circle lines extending across the exterior surface of each panel member, the great circle lines respectively interconnecting adjacent corners of spherical pentagons, spherical hexagons and partial spherical hexagons located respectively on the panel members.

10. The invention of claim 7 wherein the means for attaching the panel members to one another include a plurality of apertures in the panel members capable of receiving a plurality of bolts.

11. The invention of claim 10 wherein the apertures of the overlaying portions of the panel members are threaded and respectively engage matchingly threaded bolts, and wherein the apertures of the underlying portions of the panel members are capable of slidingly receiving one of respective bolts, the underlying portions of the panel members being attached to the bolts by means of nuts.

12. In combination:

a plurality of panel members having substantially spherical exterior surfaces of substantially identical curvature, each of the panel members being adapted for assembly to at least one other panel member in a partially overlapping configuration, the assembled panel members forming a building structure substantially having the configuration of a sphere cut off along a truncation plane, the sphere having a radius determined by the curvature of the panel members, the panel members including panel members of a first kind having a circular circumferential edge, and panel members of a second kind having a circumferential edge which has a circular arc portion, and means for receiving fastener members which attach the panel members to one another, the means being provided on each panel member in a predetermined geometrical configuration in such a manner that the means are aligned with one another in the panel members which are assembled adjacent to one another to form the building structure.

13. The invention of claim 12 wherein the panel members of the first kind in the assembled building structure have one of a spherical hexagonal and a spherical pentagonal nonoverlapping portions, and wherein the panel members of the second kind in the assembled structure have partial spherical hexagonal nonoverlapping portions.

14. The invention of claim 13 wherein the means for receiving fasteners are located on the panel members along respective great circle lines which respectively interconnect adjacent corners of spherical pentagons, hexagons and partial spherical hexagons.

15. The invention of claim 14 wherein the means for receiving fastener members comprise apertures, and wherein each aperture located in an overlaying portion of a panel member is threaded and threadedly engages a bolt in the assembled structure, and each aperture located in an underlying portion of a panel member slidingly engages a bolt in the assembled structure, the underlying portions of the panel members being attached to the bolts by means of nuts.

16. The invention of claim 14 wherein radii of the circular circumferential edges of the panel members of the first kind and radii of the circular arc portions of the circumferential edges of the panel members of the second kind, are identical.

17. A building having substantially the shape of a sphere cut off along a truncation plane, said sphere having a predetermined radius, the building comprising;

a plurality of preformed panel members attached to one another in partially overlapping configurations so that at least a portion of each panel member overlaps with at least a portion of at least one other panel member, each of the panel members having a substantially spherical exterior and a substantially spherical interior surface, the curvature of the substantially spherical surfaces being determined solely by the radius of the building, and a radius defining the curvature of the exterior surfaces of the panel members being substantially identical with the radius of the building, each panel member having substantially the same configuration in its respective preformed state as in the building.

18. The invention of claim 17 wherein the panel members comprise plastic material formed in a predetermined shape having the substantially spherical exterior and interior surfaces.

19. The invention of claim 18 wherein the panel members comprise fiberglass reinforced polyester resin.

20. The invention of claim 19 wherein the panel members are approximately $\frac{1}{8}$ of an inch thick.

21. A plurality of preformed panel members having substantially spherical exterior surfaces of substantially identical curvature, each of the panel members being adapted for assembly to at least one other panel member in a partially overlapping configuration and without substantial bending of the preformed panel members during assembly; the assembled panel members forming a building structure substantially having the configuration of a sphere cut-off along a truncation plane and having a radius determined solely by the curvature of the exterior surfaces of the panel members.

22. The invention of claim 21 further comprising assembling means for assembling the panel members to form the building structure, the assembly means being applied to the preformed panel members in a predetermined geometrical configuration indicated on the preformed panel members.

* * * * *